United States Patent [19]

Hefele

[11] 4,438,533

[45] Mar. 27, 1984

[54] INTERLINING FOR GARMENTS AND METHOD FOR THE MANUFACTURE THEREOF

[75] Inventor: Josef Hefele, Gräfelfing, Fed. Rep. of Germany

[73] Assignee: Kufner Textilwerke KG, Fed. Rep. of Germany

[21] Appl. No.: 267,658

[22] Filed: May 27, 1981

[30] Foreign Application Priority Data

Jun. 3, 1980 [DE] Fed. Rep. of Germany ..... 3021039

[51] Int. Cl.[3] ..... A41D 1/00

[52] U.S. Cl. ..... 2/97; 2/232; 156/277; 156/279; 427/206; 428/90; 428/95; 428/195; 428/198; 428/283

[58] Field of Search ..... 156/277, 279; 427/206; 428/90, 95, 195, 198, 283, 297, 329; 2/97, 232, 272

[56] References Cited

U.S. PATENT DOCUMENTS 3,540,974 11/1970 Broadhurst ..... 428/90
3,723,231 3/1973 Clay et al. ..... 428/90
3,979,538 9/1976 Gilman et al. ..... 428/90
4,180,606 12/1979 Hance et al. ..... 428/90
4,205,108 5/1980 Schmidt et al. ..... 428/90

*Primary Examiner*—James J. Bell
*Attorney, Agent, or Firm*—Scully, Scott, Murphy & Presser

[57] ABSTRACT

The invention discloses interlinings for stiffening parts of garments such as collars, cuffs, sleeves, shoulders and similar parts of outer garments.

The interlinings are particularly intended for iron-on or sewn patches and comprise; an interlining backing material consisting of a fabric which may be woven, textile or knitted, or a fleece, or simply a plurality of fibres arranged side by side; textile flock fibres having a fibre length of 0.5 to 2.0 mm and a flock binder consisting at least in part of a polymer material which is applied to the backing material in the form of a screen like imprint.

The screen like imprint may consist of a screen of dots, lines or small rods numbering from 140 to 700 per square inch. The flock binder includes micro dispersed filling materials fast to cleaning and abrasion resistant. The flocks are applied to the flock binder by an electrostatic force field of direct current with a voltage within the range 20 to 100 KV.

50 Claims, 1 Drawing Figure

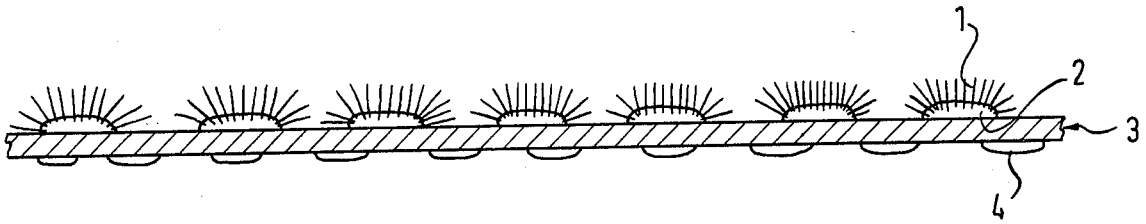
1
2
3
4

INTERLINING FOR GARMENTS AND METHOD FOR THE MANUFACTURE THEREOF

BACKGROUND OF THE INVENTION

The invention relates to new types of interlining, particularly but not exclusively, for stiffening parts of outer garments, based on conventional interlining materials which are subjected to paste pressure, and the method for the manufacture thereof. These interlinings are used primarily to stiffen fronts, collars, sleeves and similar parts of outer garments.

Despite the world-wide introduction of the so-called fixing process in which interlinings having a coating of hot-melt adhesive are bonded to materials of outer garments by ironing, so-called sewn-in patches are frequently used even today for the shoulder area of the front part of outer garments. That is, in addition to the ironed-in interlinings for fixing whole parts, which in contrast to the sewn-in patches, are applied to the whole area of the front parts of garments. The sewn-in patches are usually linen or plain weave fabrics consisting of a fine cotton warp and elastic weft threads, having a coarse titre. Woven knitted fabrics consisting of a stitch or loop forming fine denier synthetic warp and an elastic non-knitting coarse weft yarn are also used occasionally for the same purpose. The sewn patches are incorporated by sewn-in. A further additional method of stiffening the front and shoulder area consists of ironing in so-called fixed patches which are coated with heat-sealing adhesive and which, in yarn and fibre structure, correspond approximately to a whole-part interlining of finer denier which can be ironed in. Such additional ironed in fixed patches are incapable of producing the high degree of shape holding, the luxurious smooth feel and elasticity like a sewn-in patch since the double binding by ironing creates a, stiff, certain boardy, feel.

However, the sewn patch, which is incorporated in the conventional manner by sewing in and which has remained essentially without any marked change for decades, leaves much to be desired and is no longer able to meet today's higher demands for comfort. On account of their high degree of elasticity, the sewn-in patches also have a hard, wiry and often strawy character and, moreover, they are incapable of compensating for certain unavoidable disharmonies between the build or physique of the person wearing the article of clothing and the cut of the article of clothing itself so that, despite this, the wearer feels comfortable. In this case the clothier then often assists by incorporating even more bulky soft materials as padding.

In order to avoid these materials at least to some extent, other patch products have also recently come on to the market, these products consisting of double weave fabrics or woven knitted fabrics having two layers of weft threads one above the other, an elastic lower layer of weft thread and a soft raised upper layer of weft thread. Since in this case the elasticity is only produced through the weft yarn, and not also by incorporating elasticity-producing finishing agents, high pickages are necessary thereby making these two-layered articles relatively costly. The high pickages are also necessary in order to obtain adequate surface stabilization, for example in the oblique draft. Another particular disadvantage of the double weft layered woven fabrics is their high degree of warp shrinkage which cannot be eliminated by conventional finishing methods. Also, the weaving capacity is sharply reduced in the case of double fabrics and woven knotted fabrics having double layers of weft, thereby making articles even more costly.

SUMMARY OF THE INVENTION

An object of the present invention is therefore to find low-priced and non-shrink interlining materials which can be used as sewn patches and which are at the same time elastic and fully soft and, moreover, produce an even more pleasant feeling than before when an article of clothing is worn.

A further object is to find a fixed patch which has better shape holding and a less boardy feel in the double fixed section. It is a further object of the invention that the fixed patch should produce at the same time softness, fullness and elasticity. It is also an object of the invention that it should avoid other defects, such as for example greater susceptibility to shrinkage in the double fixed section and wrinkling when the double fixed section is curved. Moreover, it is an object of the invention generally to find soft, full fixed interlinings which create a bulky and smooth feel, a problem which has hitherto been solved only unsatisfactorily with fleece interlinings.

This object is achieved by providing a garment interlining for stiffening parts of garments including an interlining backing material, textile flock fibres having a fibre length of 0.5 to 2.0 mm, a flock binder comprising a screen-like applied print applied to the interlining backing material for anchoring the flock fibres, the flock binder consisting of a polymer material at least part of which is cross-linked.

The screen-like flock-binding imprint is applied primarily in dot form, dot numbers from approximately 140 to 700 per square inch, and in particular 200 to 500 per square inch, being particularly advantageous. However, a flock-binding imprint in the form of lines or small rods is also possible.

In accordance with a particular embodiment of the invention it may be preferred for the screen of the flock-binding applied print to be adapted to the length of the flock fibres in such a way that the tips of the fibre flocks situated on adjacent dots, lines or small rods almost directly overlap one another. However, advantageous interlinings can also be obtained if the minimum distance between the tips of flock fibres resting on adjacent screen dots or lines or small rods does not exceed $\frac{1}{3}$ of the distance between adjacent dots, lines or small rods of the flock binder, measured from one dot edge to another. Particularly uniform handle properties can be achieved by matching the screen of the flock binder, the distance between the screen dots and the length of the flock fibres resting on or incorporated in the dots with one another.

DETAILED DESCRIPTION OF THE DRAWING

The drawing is a diagrammatic representation of a cross-section of a garment interlining formed according to the present invention.

In accordance with a preferred embodiment of the invention the screen dots resting on the interlining material are flattened at the top and the flock fibres are arranged substantially perpendicular to the dot surface, as shown in the accompnying drawing.

Most of the conventional woven and knitted sewn patches can be directly provided with the flock-binding imprint and flock-coated. However, in the electrostatic flock coating process which is preferred, it should be ensured that the flock-coated side does not have any projecting or upright hairs or fibres, which can frequently be avoided by singeing the flock-coated side. Also, with the other interlining materials it should be ensured that there are no upright fibres so as to obtain a neat flock coating.

In addition to the interlining material already in use, hitherto unsuitable or unused two-dimensional textile structures can also be used for flock coating and can then be employed as flock-coated interlining materials, for example light fleeces having a mass per unit area of under approximately 20 g/m$^2$ can be used for fixed fleeces which can be ironed in. The use of these materials was hitherto impossible or hardly possible on account of their tendency to curl or turn back when ironed on. Likewise, it is possible to use shirt stiffening materials for flock coating according to the invention.

The sewn patches acting as a backing and proposed for the screen-like flock coating consist usually of fabrics having fine cotton warp threads and coarse weft threads, which contain horsehair, goat hair, camel hair, coarse denier rayon staple or multifilament threads, as well as synthetic monomultifilament threads or staple fibres. The woven knitted patches which are also used occasionally have a knitting or loop-forming synthetic warp instead of the cotton warp.

In place of the strong coarse denier weft threads, viscose staple yarns, cotton yarns and/or synthetic yarns having a fine to very fine denier are usually embedded in the woven or knitted fixed patches which are also proposed for the screen-like flock-coating. Finally, the fleeces contain fine viscose staple fibres and synthetic fibres, the latter being in the form of staple fibres or continuous filament yarn. The fleeces are consolidated either with the aid of binders or mechanically or thermally by sewing, spot welding or fibre interlacing.

However, certain fibrous materials which have not been previously consolidated to form two-dimensional structures are also suitable as backings for the flock layer for the purpose of producing a particularly low-priced interlining material, such fibrous materials as, for example, groups of threads arranged closely side by side, for example groups of warp threads consisting of synthetic yarns which, at right angles to the direction of the thread groups, are provided with flock-binding prints in the form of small rods or lines and flock-coated. The groups of threads are advantageously placed on a transfer carrier for printing and flock-coating and, after the flock-coated print has dried, are removed again from the transfer carrier in the form of a finished two-dimensional structure. After the coating of heat-sealing adhesive, which is preferably in the form of a dot screen, is applied to the side directed away from the flock-coated side, the two-dimensional structures can be used as interlining materials which can be ironed in. Also, the other interlinings can be coated with heat-sealing adhesive on the opposite side to the flock-coated side.

The interlining materials provided with the flock layer can also be built up in the form of zones composed of stages having different degrees of elasticity, for which purpose conventional multistage interlinings can be used for flock coating. However, it is also possible for stages having different flock layers, for example by using different screen arrangements on the flock layer, such as, in the form of zones, closer or wider setting of the dots of the dot screen, combinations of dot screens and small rod screens or line screens or by different applications of flock binder according to the type and quantity of binder or be leaving space for zones.

Certain of the commercially available flock binders based on cross-linkable aqueous dispersions are suitable and can be advantageously selected for the flock coating of the interlining materials according to the invention. The choice has to be in line with, inter alia, the desired feel of the material, penetration, anchoring on the backing material, anchoring of the flock fibres, fastness to cleaning and washing and abrasion resistance, and the printability of as wide as possible a range of interlining materials used in the clothing industry. Flock binders having incorporated therein microdispersed filling materials with a very small particle size and large specific surface have proved advantageous for these purposed since they ensure sharply outlined printing, and good anchoring of both the flock binder layer and the flock fibres therein, even though the interlinings which are incorporated in articles of clothing by sewing in and ironing in differ quite considerably in fibre strength and in finish. The filling materials are used to particular advantage in quantities from 0.5 to 5.0% in weight, but particularly and preferably in quantities from 0.7 to 3% in weight, relative to the dry weight of the flock binder paste. Although it has been found that good results can be achieved with filling materials having an average surface area ranging from approximately 25 to 600 m$^2$/g it is particularly advantageous to use filling material specifications having an average surface area within the range from 50 to 400 m$^2$/g.

It is also important that the microdispersed filling materials have a very small particle size, preferably within a range from 7 to 80 nm, and particularly advantageously within a range from 10 to 40 nm, with the particle form being approximately spherical. Within the scope of the invention it is also intended that the microdispersed filling materials be fast to cleaning and abrasion-resistant. The use of those microdispersed inorganic filling materials having a Mohs' hardness number exceeding 6, and particularly ranging from 7 to 9, are particularly advantageous. Particularly favourable results can be frequently achieved by using those filling materials which have been prepared by decomposition of the corresponding halides in the gaseous phase. For example, reference is made in this connection to the specifications of silicic acid, aluminium oxide or titanium dioxide which can be used to particular advantage and which are obtained, for example, by hydrolysis of silicon tetrachloride, aluminium trichloride, titanium tetrachloride, etc., in the gaseous phase.

In addition to the microdispersed filling materials, the flock binders based on cross-linked aqueous dispersion pastes may contain, preferably, the copolymers which have already been used for flocking purposes and which are based on acrylates and methacrylates, with water as a dispersing agent. Cross-linkable acrylonitrile-butadiene copolymers, optionally with a styrene content, in dispersion form are also suitable. Condensable cross-linking constituents co-polymerize with the polymers. For example, methyl, ethyl, butyl and isopropyl esters and other esters of higher alcohols are suitable as polymerizable esters of acrylic acid and methacrylic acid. In addition, the cross-linkable polymers can also contain therein other co-polymerizable monomer compounds, such as acrylonitrile, free acrylic acid and methacrylic acid, maleic acid, fumaric acid, vinyl acetate, vinyl chloride, vinylidene chloride, and ethylene. The co-polymerized cross-linking constituents can be selected in such a way that they cause an inherent cross-linking between the polymer molecules or initiate cross-linking with added hardeners. Inherent cross-linking produces, for example, monomethylol acrylic acid amide and monomethylol methacrylic acid amide, each incorporated in the polymer molecule. Additional hardeners are, for example, necessary with co-polymerized acrylic acid and methacrylic acid amides.

The hardeners, which can also be added to the inherently cross-linking polymers, can be condensable water-soluble resins having free or etherified methylol groups. These include carbamide resins (urea formaldehyde resins), etherified urea formaldehyde resins, melamine resins, triazone resins, tetramethylol acetylene diurea, then reactive resins, such as dimethylol ethylene urea, dimethylol dihydroxyethylene urea, dimethylol propylene urea, dimethylol-5-oxypropylene urea, 4-methoxy-5-dimethyl-N, N-dimethylol propylene resin and, finally, carbamate resins. The condensable water-soluble resins mentioned produce bridges between the above-mentioned polymers during the hardening operation.

The copolymers mentioned can also be slightly cross-linked during polymerization of the monomers used, for example by introducing divinyl compounds, such as butandiol-di(meth)-acrylate, diallyl phthalate, methylene-bisacrylamide or divinylbenzol. Preferably the divinyl compound content should not exceed in general 3% of the entire polymer.

The fastness to washing and cleaning can be increased by using slightly pre-crosslinked coplymers of this type. However, an increase in fastness to washing and cleaning and a better binding of the flock fibres can also be achieved by pre-condensation of the cross-linkable copolymers. By adding, in accordance with a preferred embodiment of the invention, duofunctional hardeners, such as dimethylol ethylene urea or dimethylol propylene urea in quantities up to 4% relative to dry weights, storage-stable pre-crosslinked dispersions, which also help to shorten the condensation time or require lower condensation temperatures, are formed in the acid medium of the copolymers. Particularly favourable results can be achieved if, in addition, cross-linkable water-soluble impure resins having corboxylic acid amido groups in the polymer molecule, for example polyacrylic acid amides and/or water-soluble copolymers of the polymethacrylate amides, are present. The content of the cross-linkable copolymers, should not exceed 5% when the duofunctional hardeners having a maximum content of 3% relative also to dry content are present at the same time. In this case the presence of the above-mentioned microdispersed filling materials is essential to prevent the otherwise very high penetration into the backing material.

A simple, preferred, method of preparing such pre-condensation products, which also allows the manufacturer of flock-binding dispersions the possibility of a qualityimproving reaction, consists of adding the duofunctional hardeners, alone or together with the polymeric carboxylic acid amides, to the acid dispersion of the cross-linkable copolymer at the normal temperature and allowing the formulation to stand for a prolonged time until the desired pre-condensation stage is reached. Then, neutralization takes place and formulation of the flock binder is effected. A further hardener is added shortly before the printing and flock-coating process.

The above-mentioned microdispersed filling materials are usually sufficient for thickening or concentrating the dispersion paste. However, additional or solitary thickening of the dispersion pastes can also be effected by using conventional printing thickeners, such as casein, modified casein, gelatines, starches and modifications thereof, gum tragacanth, alginates, polyvinyl alcohols, polyvinyl pyrrolidone, cellulose ethers, high molecular weight polyethylene oxides. Ionogenic thickeners, such as polymeric carboxylic acids, are also suitable.

In addition to the above-mentioned constituents, minor quantities of polyurethanes in dispersion form can also be included. The polyurethanes can have ultimately continuous groups which make them capable of cross-linking with the cross-linkable copolymers and/or the hardeners. The ultimately continuous groups can be for example, acid amide, OH, ketoxime urethane groups or blocked NCO groups which, under heating, liberate unblocked NCO groups.

As is customary with mixtures of similar composition, wetting agents, for example non-ionogenic addition products of fatty alcohols or phenols containing ethylene oxide, can also be added to stabilize the paste. In addition, various additives which are known per se, such as colouring agents, UV stabilizers, antioxidant agents, can be included. Antifoaming agents can also be advantageously added. Finally, hardening catalysts, such as acid generators, acids or metallic or inorganic salts, can also be added to accelerate cross-linking. Suitable acids are maleic anhydride, oxalic acid, citric acid, chloroacetic acid and toluene sulphonic acid. Suitable acid generators are their ammonium salts, ammonium chloride, ammonium rhodanide, ammonium mitrate, diammonium phosphate and others. Finally, suitable metallic salts are magnesium chloride, zinc nitrate, zinc oleate and complex salts. Polymer acid, such as polyacrylic acid or polymethacrylic acid, can also be used and have a catalysing effect alone or together with other acids, acid generators or metallic salts.

The interlining materials are usually in the form of webs of fabric which are printed with the flock binder, flock-coated, dried in a single operation or in stages and fully condensed and, optionally, coated with hot-melt adhesive on the opposite side to the flocked side. In the manufacture of ready-made clothing, sections of interlining material are then severed from the webs of fabric. However, in special cases it is also possible for sections of interlining material to be treated directly.

In a preferred method of treatment in accordance with the present invention interlining materials in the form of webs or sections (a) are imprinted with a flock-binding cross-linkable dispersion paste, (b) the said dispersion paste is flocked electrostatically, (c) then pre-stabilized by the effect of heat, and (d) finally, fully condensed under the effect of further heat at 90° to 140° C., and preferably at 100° to 130° C.

In the manufacture of interlining materials which are flock-coated in accordance with the invention, the flock fibres are advantageously "shot" electrostatically into the flock binders based on aqueous cross-linkable dispersions. It is particularly preferably if the flock coating is applied directly to the screen-like print of the dispersion paste, it being possible for the operation to be performed advantageously, for example, in an electrostatic force field of direct current using a voltage within the range from approximately 20,000 to 100,000 V. In this case it may be possible to vary the electrostatic flock coating, depending on the field of use. Thus, it may be advantageous for electrostatic flock-coating to be assisted mechanically by producing vibrations, for example by means of rotation beater shafts.

The quantity of flock fibres used in the manufacture of the flock-coated interlinings according to the invention can to some extent be dependent on the type of backing materials. Favourable results are achieved if the flock fibres are applied in quantities averaging from 5 to 30% in weight, and preferably ranging from approximately 7 to 20% in weight of the dry paste weight. Particularly optimum results are obtained by using such quantities of flock fibres, whose fibre length and strength as well as composition are controlled.

The flock fibres anchored in the flocked layer should in accordance with the invention, have a length of 0.5 to a maximum of 2.0 mm. The fibre strength preferably should be between approximately 0.9 to a maximum of 10 dtex, and preferably between 3 and 8 dtex. Cut or ground fibres can be used, for example ground cotton fibres, ground and cut rayon staple fibres and synthetic fibres. Of the synthetic fibres, polyamide fibres are again preferred. The flock fibres should normally have an antistatic reviving means in order to ensure perfect flock-coating in the electrostatic field.

The flock fibres can be natural-coloured or grey, but can also have any desired colour. In normal cases natural-coloured or grey flock fibres are sufficient.

Also, the weight of application of the flock binder is determined primarily by the type of backing material and by the desired and envisaged feel of the material. Suitable quantities for application range between 20 and 90 g/m$^2$ relative to the dry weight. In this case the dry content of the dispersion paste can vary advantageously between approximately 40% and approximately 60%. The weights of application mentioned should still be added to the above quantities of flock fibres in order to obtain the total weight of application of the new flocked layer.

Advantages can also be obtained by using heat-sensitive flock binders. When using, in accordance with a preferred embodiment of the invention, heatsensitive flock binders which coagulate within the temperature range below 100° C. and preferably between 45° and 80° C., it is possible, in the manufacture of interlining materials flock-coated in accordance with the invention, to use a multistage operation to save energy, increase production rate and preserve fibres at lower termperatures. In the first stage, imprinting, flock-coating, coagulation and/or predrying can be effected on a belt system. After leaving the belt system, the material is then advantageously bundled into hanks or skeins while in a hot state. After a certain residence or dwell time, post-condensation can finally take place in a further operation, if necessary, on a belt system. Post-condensation can also be effected in a heated chamber. If post-condensation does take place in the heated chamber, chamber temperatures between 90° and 140° C., and preferably between 100° and 130° C., are then preferred when selecting the condensation time between, for example, 1 and 24 hours.

In some cases the use of foamable dispersions can also be advantageous, it being possible for the foaming agent to be a conventional one, the decomposition of which takes place, for example, during gas generation. However, it is also possible to control the propellant, which gives rise to a partially porous screen of synthetic material, by special variation of the suspension agent or even of the type of heating conditions. By using foamed dispersions it is possible to achieve in particular a saving of material, and sometimes also an improvement in handle qualities.

The flock binder for imprinting the interlinings according to the invention can be produced, for example, preferably in the following way:

400 parts by weight of Plextol DV 300 (=60% cross-linkable aqueous polyacrylate dispersion, containing N-methylolcarboxylic acid amido groups, and containing acrylonitrile, very soft, pH value 2.5; manufacturers: Röhm GmbH, Darmstadt Germany Federal Republic.) are mixed with:

20 parts by weight of a 20% polyacrylic acid amide solution in water and 12 parts by weight of a 40% solution of dimethylolpropylene urea in water.

The mixture has a pH value of approximately 3.2 . After a dwell time of 8 days at room temperature, a pH value of 8 is set using concentrated ammonia. The dispersion, which is now precondensed and sufficiently stable for storage, is mixed, at room temperature in an evacuated high-speed mixer, with 5 parts by weight of microdispersed silicic acid prepared by flame hydrolysis of $SiCl_4$ (surface area approx. 200 m$^2$/g) and 1 part by weight of mineral oil antifoam agent. Shortly before use—23 parts by weight of a 60% aqueous solution of etherified melamine resin are agitated into a homogenous form. The dispersion paste can then be used for printing and flock-coating.

The following viscosities are measured using the Haake Viscotester, Model VT 23:

Test sample SVI, speed 5.8 r.p.m., 7,500 mPas

Test sample SVI, speed 23.4 r.p.m., 4,000 mPas.

The viscosity of the mixture can be easily varied by adding water, adding thickeners or varying the quantity of thickening agents. It is possible to vary the viscosity also by varying the quantity of microdispersed filling materials to be used. However, in this case clean printing and good anchoring should be ensured above all. As can be seen from the measured values above, the dispersion paste is thixotropic. The viscosity decreases as the speed of the rotating sample increases. Moreover, the viscosity range within which a perfect print is obtained is wide. Measured with the aid of test sample SVI and a speed of 5.8 r.p.m. the range of viscosity can be varied between approximately 4000 and 40,000 mPas.

10 parts by weight of Lutonal M 40, a 50% solution in water(=polyvinyl methyl ether; manufacturers: BASF, Ludwigshafen Germany Federal Republic), can be added to make the formulation heat sensitive. The mixture then begins to coagulate at 65° to 70° C. Conventional printing and flock-coating apparatus can be used to carry out the method. However, the screen printing process is preferred for the flock binding print in the form of dot and small rod screens, and the gravure or intaglio printing process for the line-shaped print. The screen-like printing of the flock binder, for which purpose the aforementioned dispersion paste can be used for both processes, is followed immediately by flock-coating. In this case also, it is possible to use conventional flock-coating apparatus which can consist of one or a plurality of conveyor belts, one or a plurality of flock fibre containers, a high-voltage field of approximately 20,000 to 100,000 volts, which can be applied between a vibrating metal grating below the flock fibre containers and an earthed grating below the flock fibre conducting conveyor belt, then optionally, an electrostatic precleaner, a suction cleaning device, a dryer and an aftercleaning facility. Surplus flock fibres which fall beyond the edge of the interlining and out of the flock container can be collected in a collecting hopper below the conveyor belt associated with the flock containers. The system can be provided for both the flock-coating of a web product and for interlining sections.

DESCRIPTION OF EXAMPLES

EXAMPLE 1

Flock-coated sewn patch

The backing material is a horsehair patch provided with synthetic resin and consisting of a cotton warp Nm 34/1, sett of the warp 170 threads/10 cm, a weft yarn A containing 45% of Macedonian goathair having a yarn strength of Nm=7 and 55% of viscose staple fibre (fibre length 120 to 150 mm, fibre strength 16 dtex) and the weft twine B having yarn strength of Nm=8, formed from a core thread containing cotton yarn or twist of Nm=60/1 to 20%, inserted horse mane hair to 50%, and a twist thread consisting of single-cotton yarn of Nm=10/1 to 30%. Both weft yarns are inserted in a ratio of A:B=3:1. The pickage is 150 picks/10 cm. The patch is plain weave or linen fabric. Before being given a stiff finnish, the patch was singed on the flock binder side.

Using a 15 mesh circular stencil of a screen printer (corresponding to 260 perforations per square inch) with a wall thickness of 0.20 mm and hole diameter of 0.7 mm, 60 g/m$^2$ of the above paste are printed on to the fabric web of the above-mentioned patch, corresponding to a dry flock binder coating of 34 g/m$^2$ approximately, 12 g/m$^2$ of polyamide flock fibres are spread into the print from two flock containers and inserted or 'shot' in via the high voltage field. The fabric web passes through a dryer which is heated with hot air to 150° C. and has three compartments, each 3 meters long. The fabric web speed is approximately 6 m/min. The fabric web, while hot, is bundled into hanks or skeins immediately after leaving the dryer and allowed to stand for about 24 hours on the skein in a chamber heated to approximately 110° C. In normal cases the flock binder coating is now fast to washing or dry cleaning and abrasion resistant. When necessary, post-condensation can take place in a repeated pass at the same speed and with the dryer at the same temperature setting.

In the ready-made clothing industry patch sections for stiffening the front and shoulder areas of a sack coat or overcoat are cut from the fabric web and sewn on to the reverse side of the front part which can be provided with a whole-part interlining or reinforced with a synthetic resin applied print. The unflocked side of the patch is joined to the reverse side of the outer garment material. An additional padding is no longer required. Even after lining with lining material, the front part of the article of clothing feels softer and more pleasing than a front part stiffened by conventional methods. The shape holding is distinctly improved. The wearer's article of clothing feels softer when in contact with the body and weighs lighter on the shoulders.

EXAMPLE 2

Flock-coated fixed patch

The backing material is a low-shrinkage woven knitted fabric consisting of a knitting warp having an open fringe of polyester multifilament threads, yarn strength 50 dtex, 20 capillaries, warp sett 100 fringe rows/10 cm and a single weft which is inserted into the loops or stitches and consists of viscose staple fibre of Nm 34/1, fibre strength 1.7 dtex, pickage 160 picks/10 cm.

Using a 17 mesh circular stencil of a screen printer (corresponding to 334 perforations per square inch) of wall thickness 0.20 mm and hole diameter of 0.6 mm, 50 g/m$^2$ of the above paste are printed on to the fabric web of the said woven knitted fabric, corresponding to a dry flock binder coating of 30 g/m$^2$ approximately. 10 g/m$^2$ of polyamide 6/6 having a flock fibre strength of 3.3 dtex and fibre length of 1.0 mm are spread into the print from two flock containers and 'shot' in via a voltage field of approximately 80,000 volts. Drying and condensation take place as in Example 1. The fully condensed flock-coated fabric is subsequently coated on the unflocked side with polyamide hot-melt adhesive paste in the 11 mesh screen (corresponding to 140 dots per square inch). In the manufacture of ready-made clothing, sections for stiffening the front and shoulder areas of a sack coat or overcoat are cut from the fabric web and ironed on to front parts which can be provided with whole-part interlining or reinforced on the reverse sides with synthetic resin. An additional layer of padding is not required. The stiffening on the front and shoulder areas is clearly more textile than a reinforcement ironed on to the front and shoulder areas by conventional methods. The boardy character has disappeared. The shape retention is also significantly improved.

The said woven knitted interlining can also be used as a whole-part interlining for reinforcing the reverse side of part of or the whole of the front area of a sack coat, lady's suit or overcoat. It can also be used to stiffen lapels, collars, cuffs and sleeve edges. The improved shape holding and the more textile and softer bulkier feel are also impressive features in this case.

EXAMPLE 3

Flock-coated fixed multistage patch

The material used as backing is a low-shrinkage mulistage patch, the warp of which is symmetrically graded and consists of yarn material with variable elasiticty. The warp threads of the edge zone having a width of 19.1 cm consist in each case of two cotton twists A of thread Nm 34/ double and of a twisted thread B, which is formed from 9-capillary rayon multifilament yarn of yarn strength Nm 14.4 with single-cotton yarn, yarn strength Nm 60. This is followed by a 10 cm wide zone consisting in each case of four threads A and a thread B, followed by a 10.5 cm wide zone of threads A. The next zone in the warp has a width of 3 cm and contains in each case one thread A and two cotton twisted threads C having a thread strength of Nm 85/double. Finally, this is followed by a further zone, 3.2 cm wide and having warp threads C. From this point the warp threads are inserted symmetrically. 3.2 cm of the warp threads C are followed by 3.0 cm warp threads A and C in a ratio of 1:2, then 10.5 cm warp threads A, then 10.0 cm warp threads A and B in a ratio of 4:1, and finally, 19.1 cm warp threads A and B in ratio of 2:1. The sett of the warp threads is 160 threads/10 cm. Single-cotton threads of Nm 60 and having a pickage of 95 picks/10 cm are inserted in the form of weft threads. The multistage interlining is plain weave or linen fabric.

The interlining is coated with flock binder, flock-coated, predried and fully condensed as in Example 1.

After condensation the unflocked side of the multistage interlining is coated with polyamide hot-melt adhesive paste in the 11 mesh screen, as in Example 2. In the manufacture of ready-made clothing, sections for reinforcing the front and shoulder areas of a sack coat or overcoat are cut from the fabric and ironed on to front parts, which can be provided with whole-part interlinings or reinforced on the reverse sides with synthetic resin, in such a way that the elastic warp threads lie on the shoulder area and the less elastic warp threads of the multistage interlining lie on the front area. An additional layer of padding is not required in this case. The front and shoulder stiffening is likewise clearly more textile than sections ironed by conventional methods on to the front and shoulder parts using unflocked multistage interlinings. The boardy characted has disappeared. The grading of the handle and the shape holding are also significantly improved.

EXAMPLE 4

Flock-coated fleece interlining for ironing on to articles of clothing

A spunbonded fabric, which is welded in the form of a dot screen and consists of polyamide 6 continuous filaments and which has a fleece weight of 15 g/m$^2$, serves as a backing material for the flock coating. A transfer strip of thick polyester fabric, coated with silicon, is used as a printing pad. The fleece is placed on the transfer strip and fed, together with the latter, to the rotary screen printer from Example 2 and printed, flock-coated and condensed as in Example 2. After leaving the dryer in the first pass, the transfer strip is removed and wound up separately. The fully condensed flock-coated fleece is then coated on the unflocked side with a polyamide hot-melt adhesive paste in the 15 mesh screen (corresponding to 260 perforations per square inch). In the manufacture of ready-made clothing, sections for stiffening the front and shoulder areas of a sack coat are cut from the fabric and ironed on to front parts which can be provided with whole-part interlinings or reinforced on the reverse sides with synthetic resin. An additional layer of padding is not required. The front and shoulder stiffening is clearly more textile than a fleece interlining ironed on by conventional methods. Despite the bulky handle, 'elephant hide' formations when the doubly reinforced area is curved, which frequently occur with bulky fleece stiffening, are avoided. The frequently flat and boardy character of a double stiffening with a fleece layer has also disappeared. Shape holding is also significantly improved.

The said flock-coated fleece interlining can also be used as a whole-part interlining for stiffening the reverse side of a part of or the whole of the front area of a sack coat, lady's suit or overcoat. It can also be used for the edge stiffening of lapels, collars, cuffs and sleeves. The good shape holding and the textile soft, bulky handle are also impressive features in this case.

The strong tendency of a fleece of only 15 g/m$^2$ to turn back is also completely eliminated.

EXAMPLE 5

Flock-coated fixed interlining, formed by a thread layer

In this case a two-dimensional fabric structure is not used as a backing for the flocked layer, but merely a thread layer which is tensioned in the warp direction and consists of 20- capillary polyester multifilament yarns having a thread strength of 44 dtex and a sett of 200 threads/10 cm. The transfer strip of Example 4 serves as a printing pad. The group of threads is placed on the transfer strip and, together with the latter, is fed to the nip of a pair of rollers consisting of an engraved steel printing roller and a non-engraved grounding-in steel roller. Parallel to the roller axis, the engraved roller is provided with line grooves having a depth of approximately 0.4 to 0.6 mm and a conical or rounded cross-section. The conical grooves are approximately 0.6 mm in depth, and approximately 1.2 mm in height. The spacing between the grooves is approximately 1.1 mm. Smaller dimensions can also be selected. When a slight pressure is applied by the pair of rollers, the thread layer and the transfer strip guided under the layer receive the flock binder paste which is fed into the grooves by means of a doctor and which is applied at right angles to the direction of the thread layer. Approximately 60 g/m$^2$ of the above-mentioned flock binder paste are applied, corresponding to a dry flock binder coating of approximately of 34 g/m$^2$ approximately 12 g/m$^2$ of polyamide flock fibres are spread into the print from two flock containers and 'shot' in via the high voltage electrostatic field. Drying and condensation take place as in Example 1. After leaving the dryer in the first pass, the transfer strip is separated from the printed thread layer. The thread layer, which is line printed with flock binder paste, is now a two-dimensional fabric structure. The two-dimensional structure is subsequently coated on the unflocked side, as described in Example 2, with a polyamide hot-melt adhesive paste using an 11-mesh screen. The two-dimensional structure, which can be ironed in, can be used as a whole-part interlining for reinforcing the reverse side of a part of or the whole of the front area of a sack coat, lady's suit or overcoat. It can also be used for the edge stiffening of lapels, collars, cuffs and sleeves. It has a very high dimensional stability, has a soft textile feel and is highly elastic at right angles to the thread direction, a quality or property which commends the use of the fixable two-dimensional fabric structure also for elastic materials for outer garments. The economical method of producing the fabric structure should also be mentioned. A weaving or knitting process is avoided when manufacturing the two-dimensional fabric structure.

In the accompanying drawing the reference numeral 3 denotes a backing to which the flock binder 2 is applied. The flock fibres 1 are fixed on this flock binder 2. The hot-melt adhesive 4 is provided on the underside of the backing.

I claim:

1. In a garment having an interlining for stiffening parts of the garment, an improved interlining which imparts bulk and a smooth hand feel to the garment, said interlining comprising:

(a) an interlining backing material, (b) textile flock fibres having a fibre length of 0.5 to 2.0 mm, (c) a flock binder comprising a screen like applied print applied to the interlining backing material for anchoring the flock fibres, the flock binder consisting of a polymer material at least part of which is cross-linked.

2. In a garment, an interlining according to claim 1, wherein the flock binder is in the form of a screen of dots numbering from 140 to 700 per square inch.

3. In a garment, an interlining according to claim 1, wherein the flock binder is in the form of a screen of small rods.

4. In a garment, an interlining according to claim 1 or 2, or 3 wherein the screen of the flock-binder is adapted to the length of the flock fibres in such a way that the tips of the fibre flocks situated on adjacent prints of binder touch but do not overlap the adjacent binder.

5. In a garment, an interlining according to claim 1 or 2 or 3, wherein the minimum distance between the tips of flock fibres on adjacent screen prints does not exceed ⅓ of the distance between adjacent prints of the flock binder, measured from one print edge to another.

6. In a garment, an interlining according to any one of the claims 1 or 2 or 3 wherein the screen prints resting on the interlining are flattened at the top and the flock fibres are arranged substantially perpendicular to the screen print surface.

7. In a garment, an interlining according to any one of claims 1 or 2 or 3 wherein the interlining backing comprises a fabric patch, wherein a coating of heat-seal adhesive is provided on one side of the patch for securing it to the inner side of a garment.

8. In a garment, an interlining according to any one of claims 1 or 2 or 3 wherein the interlining backing material comprises a fleece patch, wherein a coating of heat-seal adhesive is provided on one side of the patch for securing it to the inner side of a garment.

9. In a garment, an interlining according to any one of claims 1 or 2 or 3 wherein the interlining material is formed from a plurality of fibres arranged side by side.

10. In a garment, an interlining according to claim 7, wherein the interlining material forms a multistage interlining.

11. In a garment, an interlining according to claim 1 wherein the flock binder comprises a dispersion paste, and microdispersed filling materials having an average surface area of 25 to 600 $m^2/g$, in relation to the dry weight of the dispersion paste.

12. In a garment, an interlining according to claim 11, wherein the filling materials have an average surface area of 50 to 400 $m^2/g$.

13. In a garment, an interlining according to claim 11 or 12 wherein the filling material content is in a quantity from 0.5 to 5% in weight relative to the dry weight of the dispersion paste.

14. In a garment, an interlining according to claim 11, wherein the flock binder contains filling materials which are fast to cleaning and abrasion-resistant and which have been prepared by decomposition of corresponding halides in the gaseous phase.

15. In a garment, an interlining according to claim 11, wherein the filling material is selected from one or more of the group of: microdispersed silicic acid, alumimium oxide or titanium dioxide.

16. In a garment, an interlining according to claims 1 or 2 or 3 wherein the flock binder comprises cross-linked copolymers and divinyl compounds, with a maximum of 3% of the divinyl relative to the dry weight of the entire polymer.

17. In a garment, an interlining according to any one of claims 1 or 2 or 3 wherein the flock binders comprise duofunctional hardeners and cross-linkable copolymers, which are pre-condensed, with a maximum of 4% of the duofunctional hardeners relative to the dry weight of the entire polymer.

18. In a garment, an interlining according to claim 1 wherein the flock binder comprises dimethylol ethylene urea and cross-linkable copolymers, which are pre-condensed with a maximum of 4% of the dimethylol ethylene urea relative to the dry weight of the entire polymer.

19. In a garment, an interlining according to claim 1 wherein the flock binder comprises dimethylol propylene urea and cross-linkable copolymers which are pre-condensed with a maximum of 4% of the dimethylol propylene urea relative to the dry weight of the entire polymer.

20. In a garment, an interlining according to claim 1 wherein the flock binder includes cross-linkable copolymers, which are pre-condensed with water-soluable polymeric resins, with carboxylic acid amido groups in the polymer molecule having a resin content up to a maximum of 4% and with duofunctional hardeners up to a maximum of 3% relative to dry weight of the entire polymer.

21. A method of manufacturing an interlining according to claim 34, wherein the flock binder includes dispersion pastes, which are applied in screen form, and are flocked in an electrostatic force field of direct current having a voltage within the range from 20 to 100 KV.

22. In a garment, an interlining according to claim 1 or 2 or 3 or 11 wherein the flock binder includes a heat-sensitive dispersion paste, which coagulates in a temperature range below 100° C.

23. In a garment, an interlining according to claim 22 wherein the dispersion paste coagulates at a temperature in the range between 45° C. and 80° C.

24. In a garment, an interlining according to claim 1 wherein the flocks have a fibre thickness within a range from 0.9 to a maximum of 10 dtex.

25. In a garment, an interlining according to claim 1 wherein the flocks have a fibre thickness within a range of between 3 and 8 dtex.

26. In a garment, an interlining according to claim 1 or 2 or 3 or 11 or 24 wherein the flock fibres are synthetic fibres.

27. In a garment, an interlining according to claim 28 wherein the flock fibres have polyamide base.

28. In a garment, an interlining according to claims 1 or 2 or 3 wherein the cross-linking material of the flock binder is polyacrylate.

29. In a garment, an interlining according to claim 28 wherein the polymer material of the flock binder is a copolymer selected from the group of acrylic esters or methacrylic esters.

30. In a garment, an interlining according to claim 28 wherein the polymer material of the flock binder is a cross-linkable acrylonitrilebutadiene copolymer.

31. In a garment, an interlining according to claim 30 wherein the copolymer has a styrene content.

32. In a garment, an interlining according to claim 1, wherein the block binder is in the form of a screen of lines.

33. In a garment having an interlining for stiffening parts of the garment, an improved interlining which imparts bulk and a smooth hand feel to the garment, said interlining comprising:

(a) a substrate material, said substrate having a first side for receiving a flock and a second side for applying the interlining to the inner side of a garment fabric, (b) a flock binder lined to the substrate in the form of a pattern screen, said pattern having an application density of 140 applications per square inch of said substrate, said flock binder consisting of a polymer material at least part of which is cross-linked, (c) flock fibres embedded in said flock binder, said fibres having a fibre length of 0.5 to 2.0 mm.

34. A garment having improved bulk and hand feel; said garment comprising:

(a) an outer layer, (b) an inner layer, (c) an interlining between said outer layer and said inner layer, said interlining having;

(i) a substrate material, said substrate having a first side for receiving a flock and a second side for applying the interlining to the inner side of a garment fabric, (ii) a flock binder lined to the substrate in the form of a pattern screen, said pattern having an application density of 140 applications per square inch an said substrate, said flock binder consisting of a polymer material at least part of which is cross-linked, (iii) flock fibres embedded in said flock binder, said fibres having a fibre length of 0.5 to 2.0 mm.

35. A garment according to claim 34 wherein the screen of the flock binder is adapted to the length of the flock fibres in such a way that the tips of the fibre flocks situated on adjacent applications touch but do not overlap the adjacent application of the binder.

36. A garment as claimed in claim 34 wherein the minimum distance between the tips of flock fibres on adjacent screen applications does not exceed $\frac{1}{3}$ the distance between adjacent applications of the flock binder, measured from one application edge to another.

37. A garment as claimed in claim 40 wherein the screen applications resting on the interlining are flattened at the top and the flock fibres are arranged substantially perpendicular to the screen application surface.

38. A garment as claimed in claim 34 wherein the interlining substrate has a coating of heat seal adhesive applied to the second side for attaching it to the outer layer of said garment.

39. A garment as claimed in claim 38 wherein the interlining substrate is a fleece material.

40. A garment as claimed in claim 40 wherein the interlining material forms a multistage interlining having a varying screen pattern.

41. A garment as claimed in claim 34 wherein the flock binder contains filling materials which are fast in cleaning and abrasion resistance and which have been prepared by decomposition of corresponding halides in the gaseous phase.

42. A garment as claimed in claim 34 wherein the flock binder comprises duofunctional hardeners and cross linkable copolymers, which are precondensed, with a maximum of 4% of the duofunctional hardeners relative to the dry weight of the entire polymer.

43. A garment as claimed in claim 34 wherein the flock binder includes a heat sensitive dispersion paste, which coagulates in a temperature range below 100° C.

44. A garment as claimed in claim 34 wherein the fibre flocks have a fibre thickness within a range of between 3 and 8 dtex.

45. A method of manufacturing an interlining according to claim 21, wherein the flocks are applied by shooting the flock in a quantity averaging from 5 to 30% the weight of the paste.

46. A method of manufacturing an interlining according to claim 45 wherein the flocks are applied by shooting the flock in a quantity averaging from 7 to 20% the weight of the paste.

47. A method of manufacturing interlinings for use in garments, said method comprising:

(a) printing an interlining material backing with a pattern of flock-binding cross-linkable dispersion paste with a pattern having an application of paste ranging from 140 to 700 application per square inch, (b) electrostatically flocking the dispersion paste with flock fibres having a fibre length of 0.5 to 2.0 mm, (c) applying heat to pre-stabilize the binder, and (d) finally, fully condensing the binder with further heat at 90° to 140° C.

48. A method according to claim 47 wherein the final step of fully condensing is carried out at a temperature between 100° C. and 130° C.

49. A method according to claim 47 or 35 wherein heating is effected first at a lower temperature to achieve coagulation and second at a higher temperature to harden the dispersion paste.

50. A method according to claim 47 or 48 wherein the pre-stabilizing step is carried out by heating to a temperature in the range below 80° C. and then the fully condensing step is carried out.

* * * * *